United States Patent [19]

Schmidt

[11] 3,993,335

[45] Nov. 23, 1976

[54] PANIC EXIT DEVICE

[75] Inventor: Joseph J. Schmidt, Los Angeles, Calif.

[73] Assignee: Builders Brass Works Corporation, Los Angeles, Calif.

[22] Filed: Apr. 12, 1974

[21] Appl. No.: 460,390

[52] U.S. Cl. ..... 292/21; 292/336.3

[51] Int. Cl.[2] ..... E05C 9/14

[58] Field of Search ..... 292/21, 92, DIG. 27, 292/336.3, 167, 139, 59, 36; 70/92

[56] References Cited

UNITED STATES PATENTS

| | | | |
|---|---|---|---|
| 1,792,537 | 2/1931 | Irwin | 292/59 |
| 2,705,882 | 4/1955 | Craig | 292/DIG. 27 |
| 2,803,479 | 8/1957 | Young et al. | 292/169.15 |
| 3,123,387 | 3/1964 | Jackson et al. | 292/21 |
| 3,334,500 | 8/1967 | Bejarano | 70/92 |

*Primary Examiner*—Richard E. Moore
*Attorney, Agent, or Firm*—Lyon & Lyon

[57] ABSTRACT

The invention disclosed herein provides a panic exit device for doors having in their active side vertically operating bolts extending from the top and bottom of the door and a mechanism for retracting the bolts. Usually, the retracting mechanism may be activated by using a key in an exterior door lock or by depressing a panic bar on the interior of the door. The improved panic exit device of this invention provides a device for actuating the bolt retraction mechanism which is mounted on the interior of the door and is non-handed so as to allow reversible installation of the retracting device on a right-handed or left-handed opening door. The panic exit device of the invention also provides an improved mechanism for latching the bolts in the retracted position as well as an improved dogging mechanism to lock the actuator device in the actuated position, while simultaneously preventing excessive play in the panic bar. As a further improvement, the actuator device of the invention is designed to be readily mounted on shoulder screws placed in the stiles of the door which additionally serve to hold the lock retraction mechanism in place within the active stile of the door.

13 Claims, 11 Drawing Figures

PANIC EXIT DEVICE

BACKGROUND OF THE INVENTION

This invention relates to panic exit devices having one or more vertically operating bolts at the top and/or bottom of the door. An example of such a device wherein the bolts may be retracted solely by means of a key operated lock which also services to lock the bolts in the retracted position or by depressing a panic bar, is described in the United States Patent to T. Bejarano, U.S. Pat. No. 3,334,500.

There are numerous types and styles of mechanisms used for operating the popular commercial and industrial door latch where the bolts reciprocate vertically and extend from the top and bottom of the door. Most of these mechanims include or are adapted to include a panic bar release arrangement on the inside of the door for rapid and foolproof actuating of the bolts by merely depressing the panic bar to open the door. Many such mechanisms include an often desirable feature of permitting manipulation of a device to latch the bolts in a retracted position during business hours or the like, whereby the door is free to swing open without operating the panic bar or hitting any other release mechanism. This is known in the industry as a "dogging" feature and is usually accomplished by flipping a lever or threading a screw into a position to block the operating mechanism in the depressed position of the panic bar or other release mechanism. Often, it is particularly desirable that this dogged condition of the door not be inadvertantly or maliciously released and therefore, a special tool or unique knowledge might be required to set and release the dogging mechanism. For example, a recessed screw has been used as the actuating means for the dogging mechanism whereby a screwdriver and considerable effort are needed for actuation, but this has the inherent objectionable feature of requiring a substantial amount of the authorized operator's time to actuate the dogging mechanism. Another now-conventional arrangement as shown in the aforementioned U.S. Pat. No. 3,334,500 provides a pivotable stud having a relieved shank portion adapted to engage a portion of the bolt retraction mechanism so as to reach a dogged condition with a ½ turn rotation of the stud. Although this dogging arrangement is an improvement over other methods, it results in the tension being removed from the panic bar handle, leaving it in a flopable condition.

Another feature that is often required with this type of bolt mechanism is the provision of a keyed exterior lock to permit opening of the door from the outside. Conventionally, these mechanisms are provided with an exterior lever or knob which is released by the operation of the keyed lock and then may be manipulated to retract the bolts for opening the door. Alternatively, the keyed lock may operate a separate bolt which must be released before the door may be opened by the operation of the knob or lever. U.S. Pat. No. 3,334,500 provides a vertical bolt operating mechanism capable of actuation by an exterior keyed lock, wherein the bolts may be latched in their retracted position by appropriate manipulation of the keyed lock in conjunction with manipulation of an interiorly facing operating means, and that arrangement is particularly suitable for and compatible with the present invention.

Still another desirable feature in many installations of this type of bolt mechanism is to minimize the size of both the door stile containing the bolts and the mechanism for operating the bolts. This is particularly desirable with glass doors which derive their esthetic quality from their uncluttered look. The particular locking mechanism disclosed by Bejarano allows such a narrow door stile. Additionally, it is desirable to provide an exit device which may be easily and economically mounted on the door stile, regardless of whether the bolt mechanism is on the left hand or right hand stile.

To provide smooth operation of installations of this type, some form of bolt latching mechanism is usually provided which retains the bolts in the retracted position when the interior or exterior actuating device is operated during the time the door is open. This prevents the need to continue pressure on the panic bar or key in order to prevent the bolt from contacting the ground while the door is swinging open and closed. The bolt latching mechanism is usually designed to trip and release the bolt when the door reaches the closed position. U.S. Pat. No. 3,334,500 shows such a latching mechanism. However, latching mechanisms of this type have proved unsatisfactory, since the bolt which is screwed on the connecting shaft must be rotated a full 360° in order to vary the portion of the bolt which extends above and below the door. This often results in situations where one turn more is too much, but the present length is not enough. Therefore, it would be desirable to provide a bolt latching mechanism which allows more flexability in adjusting the length of the bolt extending above or below the door.

SUMMARY OF THE INVENTION

Thus, there is provided by the invention disclosed herein an improved panic exit device which overcomes many of the inadequacies of panic exit devices known to the prior art. The invention provides for the mounting of a novel actuator device on the internal side of the door for causing the vertical movement of the projecting actuating pin of a particular type of conventional retraction mechanism for vertically operating bolts which retracts the bolts. The actuator device comprises an active unit housing mounted on the active stile over the actuating pin and an inactive unit housing mounted on the inactive stile. Both unit housings employ a novel mounting on shoulder screws fitted into the stiles. Preferably, the shoulder screws on the active stile serve the additional function of holding the body of the locking bolt retraction mechanism in a fixed position in the interior of the active stile.

An object of the invention is to provide a novel panic exit device in which the active and inactive unit housings are identical except for being right-handed and left-handed, and the fact that the active unit contains an actuator link. By merely switching that actuator link from one unit to the other, they can be used on right-handed or left-handed opening doors.

Another object of this invention is to provide a novel form of dogging means for the actuator device wherein a spring biased dogging pin is effectively concealed in a recess and yet is readily operable by authorized personnel by appropriately depressing and turning the dogging pin. A still further object is to provide such an arrangement in which, in the dogged position, the panic bar of the device is securely held in the depressed position by the dogging pin.

Yet another object of the invention is to provide a novel actuator link shaped to engage only the underside of the actuating pin of a conventional retraction mechanism to thereby allow the panic exit device to return to its normal, undepressed position even though the actuating pin remains in the upper, bolt retraction position.

Still another object of the invention is to provide bolt latching means and hexagonal locking bolts within a conventional retraction mechanism so that the distance the bolts protrude above or below the door stile may be adjusted with precision.

DETAILED DESCRIPTION OF THE INVENTION

Figure 1:
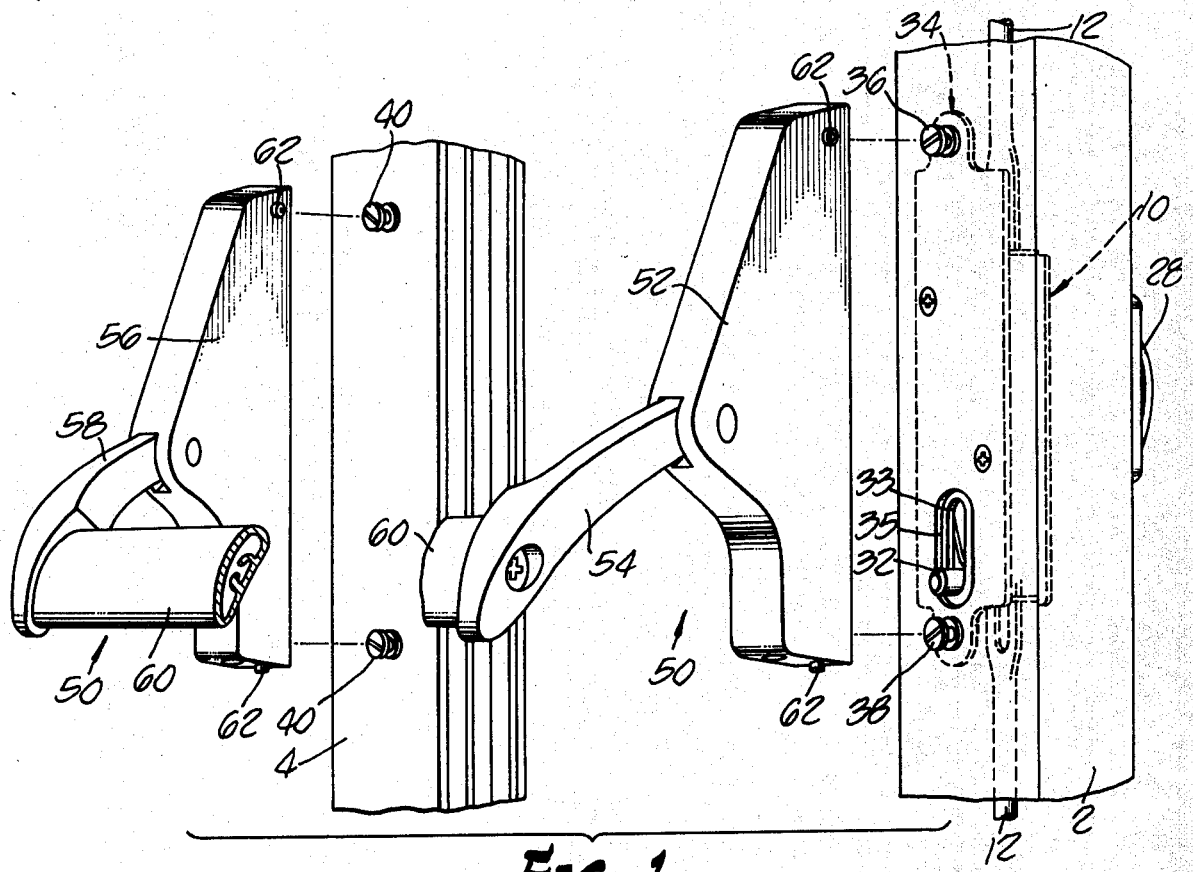
FIG. 1 is a fragmentary perspective view of an embodiment of the invention showing the mounting relationship of the actuator device to the inactive and active stiles.

In one embodiment, depicted in FIG. 1, the panic exit device of the invention will be mounted on a door having active stile 2 and inactive stile 4, it being understood that the term active stile merely refers to the edge of the door which opens and closes and the inactive stile refers generally to the hinged side of the door. Although active stile 2 and inactive stile 4 as depicted are of a design suitable for framing a glass door, it is within the scope of the invention to mount the panic exit device on any type of door having an active stile as hereinafter described. Mounted internally in the active stile is a locking bolt retraction mechanism, generally designated 10 and more clearly depicted in FIGS. 2–5. Locking bolt retraction mechanism 10 includes connector rods 12 and 14 and springs 16 and 18 which urge the connector rods upwardly and downwardly respectively. Locking bolts 20 and 22 are threadably mounted on the end of connector rods 12 and 14 respectively so that in the normal locked, extended position they engage recesses 24 and 26 in the doorway to lock the door in the closed position. The retraction mechanism 10 may be actuated to cause reciprocating vertical retraction movement of locking bolts 20 and 22 by inserting and turning a key in key mechanism 28, thereby rotating lever arm 30. Alternatively, the actuating mechanism may be actuated by the vertical movement of actuating pin 32. The retraction mechanism is essentially mounted in retraction mechanism case 34 which is securely fastened to active stile 2 by shoulder screws 36 and 38. Actuating pin 32 protrudes through slot 33 in case 34 and slot 35 in active stile 2. Shoulder screws 40 may be mounted on inactive stile 4 directly opposite shoulder screws 36 and 38.

On the interior of the door there is provided an actuator device generally designated as 50 comprising an active housing 52 having arm 54 pivotally mounted therein, inactive unit housing 56 having arm 58 pivotally mounted therein and panic bar 60 attached at one end thereof to arm 58 and at the other end thereof to arm 54. The actuator device is mounted on the door by attaching inactive housing 56 to shoulder screws 40 and active housing 52 to shoulder screws 36 and 38 by means of set screws 62.

Figure 9:
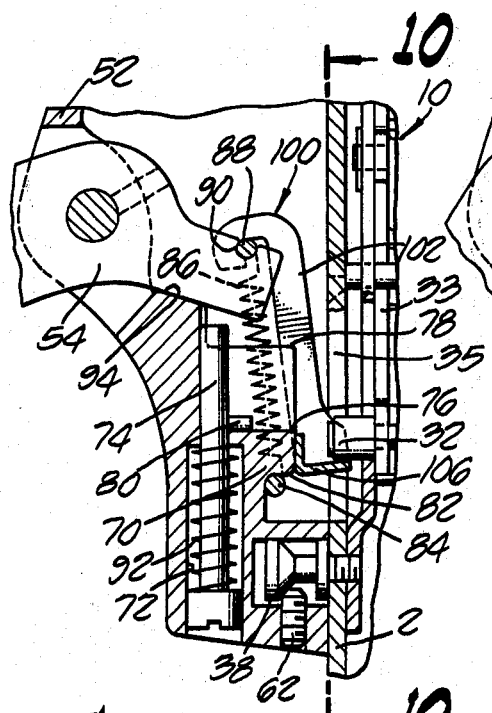
FIG. 9 is a fragmentary sectional elevation of an actuator device of the invention mounted on an active door stile in the inactive position.
Figure 11:
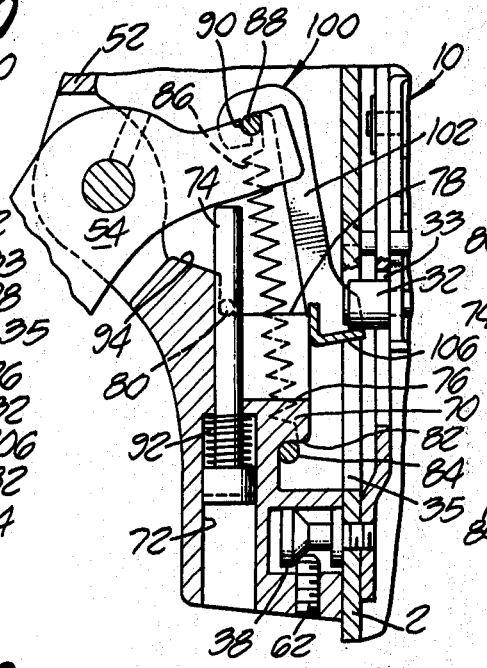
FIG. 11 is a fragmentary sectional elevation similar to FIG. 9 with the actuator device in the active position.

Active housing 52 is outfitted as described hereinafter to have an active and an inactive position. The active position occurs when panic bar 60 is depressed causing pivotal motion of arms 54 and 58 which results in vertical upward movement of actuating pin 32 thereby retracting bolts 20 and 22. The inactive and active positions are depicted in FIGS. 9 and 11 respectively.

Active housing 52 is provided with boss 70 near the lower portion thereof. Boss 70 is outfitted to receive the dogging means of the actuator device and to cooperate with the biasing means. Thus, boss 70 is provided with bore 72 for receiving dogging pin 74 which has roll pin 80 mounted in a lateral hole therein and projecting laterally therefrom. Dogging pin spring 92 is mounted on dogging pin 74 within bore 72 to urge the dogging pin out of active housing 52. The dogging pin is restrained within the active housing by the provision on boss 70 of ledge 76 on which roll pin 80 rests when the dogging means is in the inactive position. In this position, the top of dogging pin 74 does not engage arm 54 which is held on ledge 94 provided on boss 70 by biasing means.

Figure 10:
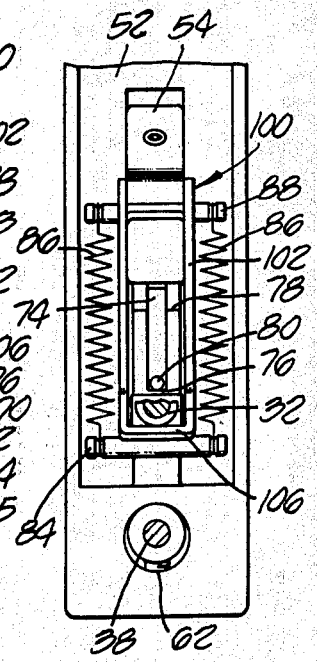
FIG. 10 is a fragmentary sectional elevation of an actuator device of the invention taken along the line 10—10 shown in FIG. 9 in the direction of the interior of the door.
Figure 3:
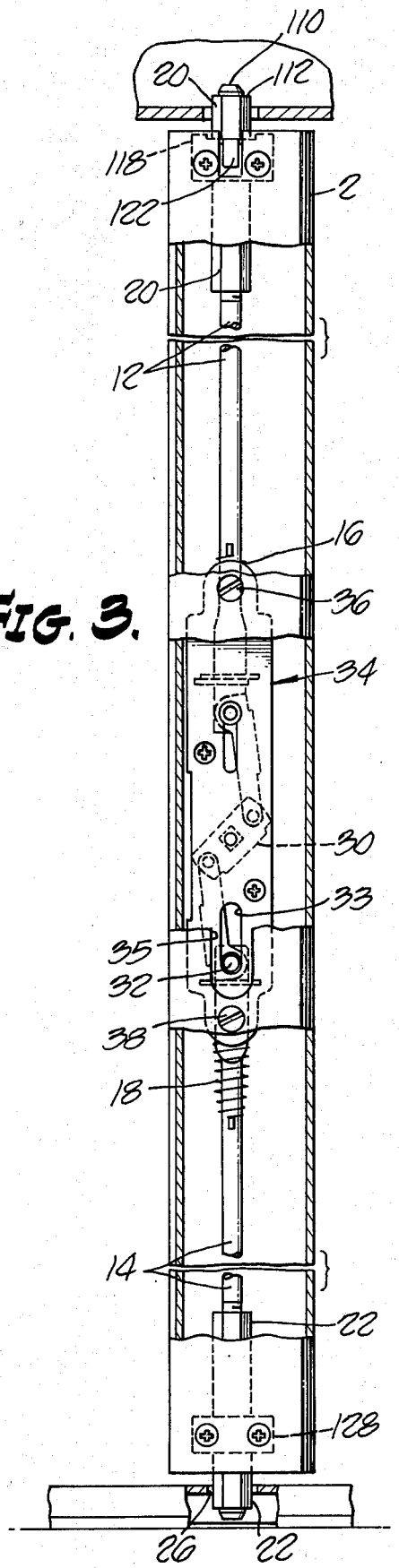
FIG. 3 is a fragmentary sectional elevation of the active door stile taken from the interior side of the stile with the locking mechanism in the inactive position.
Figure 2:
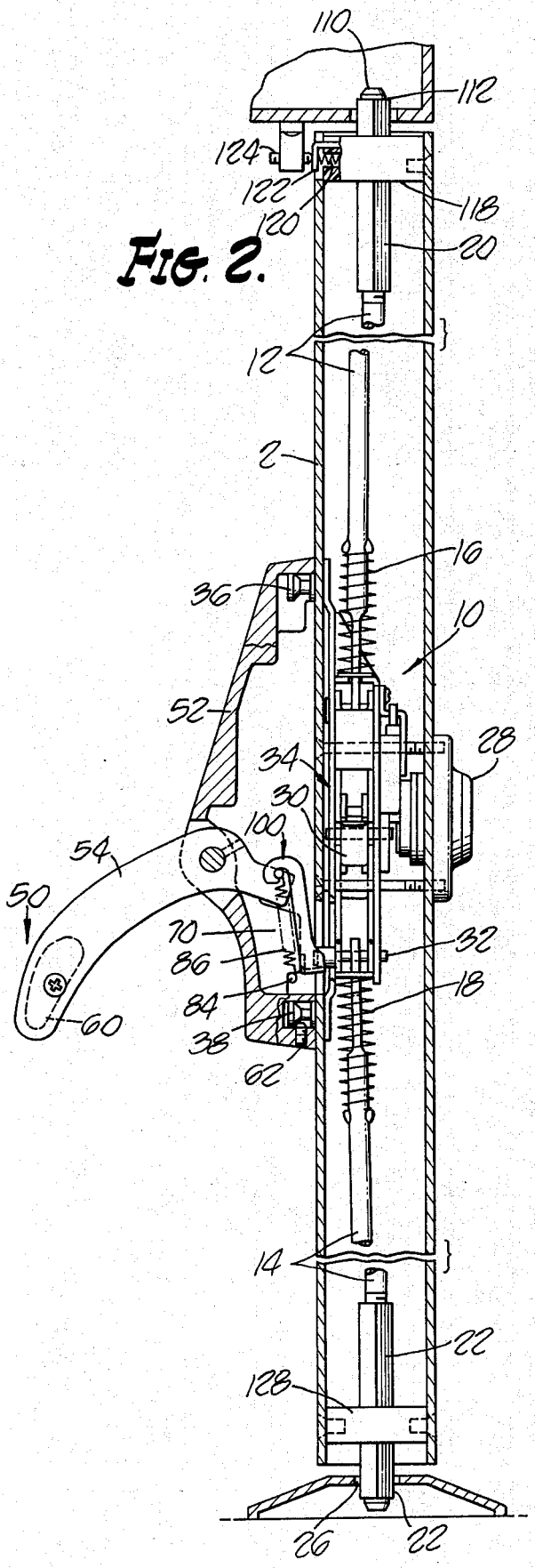
FIG. 2 is a sectional side elevation of an active door stile of the invention with the locking mechanism mounted therein and the actuator device mounted on the stile in the inactive position.
Figure 5:
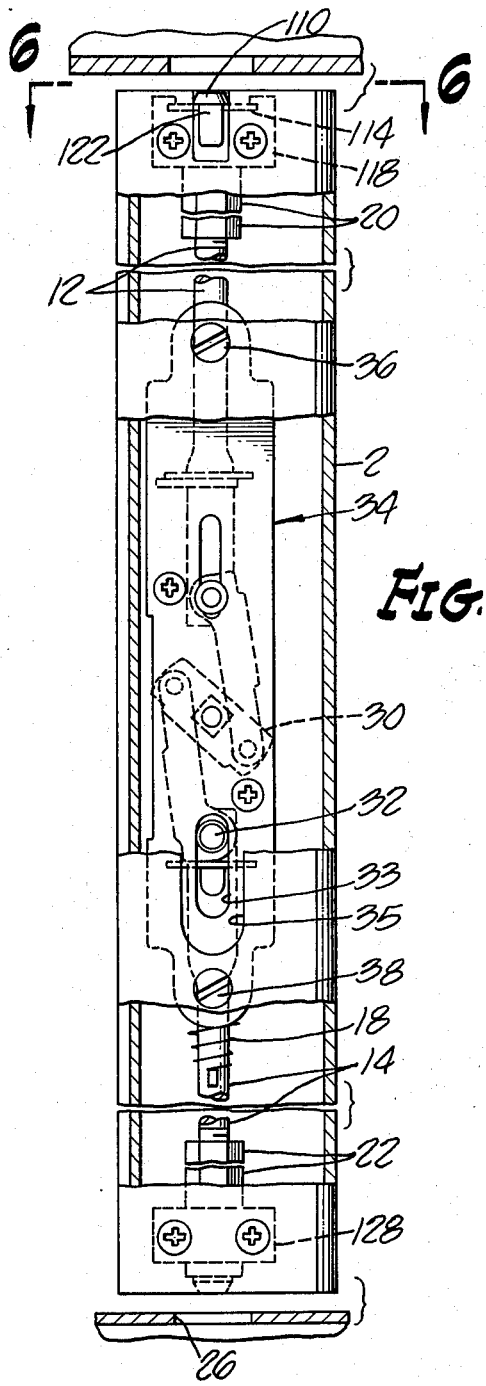
FIG. 5 is a fragmentary sectional elevation of the door stile taken from the interior side of the stile with the locking mechanism in the active position.

Boss 70 is also provided with ledge 82 which cooperates with the biasing means to allow arm 54 to be biased in the extended, inactive position depicted in FIGS. 1, 2, and 10. In the embodiment of the invention depicted in the drawings, the biasing means is comprised of springs 86 and spring pins 84 and 88. Springs 86 are mounted at one end thereof on opposite ends of spring pin 84 and at the other end thereof on opposite ends of spring pin 88. Spring pin 88 is mounted in notch 90 provided on the upper side of arm 54 and spring pin 84 is mounted on downwardly facing ledge 82 whereby the end of arm 54 containing notch 90 is biased downwardly by the tension of springs 86.

Figure 8:
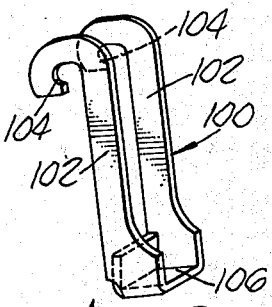
FIG. 8 is a perspective view of one embodiment of the actuator link of the invention.

Active unit housing 52 also has removably mounted therein actuator device 100 shown in detail in FIG. 8. Actuator device 100 comprises, in this embodiment, sides 102 terminating in hooks 104 at one end thereof and basket 106 at the other end thereof. Actuator link 100 is fabricated to removably engage spring pin 88 at hooks ends 104. When the active unit housing is in the inactive position as in FIG. 9, actuator link basket 106 engages the bottom of actuating pin 32 within slot 35.

When panic bar 60 is depressed, arms 54 and 58 pivot causing actuator link 100 to rise to the position shown in FIG. 11, carrying with it actuating pin 32. The length of travel of pin 32 is sufficient to retract locking bolts 20 and 22 from recesses 24 and 26 allowing the door or be opened. Where a latching mechanism is provided to latch locking bolts 20 and 22 in the retracted position, the latched condition is also effected by the movement of pin 32 caused by depressing panic bar 60. When locking bolts 20 and 22 are latched in the retracted position, actuating pin 32 remains in the raised position shown in FIG. 11. If the dogging mechanism is not employed, the tension of springs 86 will return actuator device 50 to the inactive position.

If it is desired to restrain the locking bolts in the retracted position regardless of whether a latching mechanism is employed or where employed has been tripped, the actuator device may be dogged in the activated position by forcing dogging pin 74 into the active unit housing and rotating it 90° or less so that roll pin 80 engages ledge 78 on boss 70 thereby restraining arm 54 from being returned to the inactive position. This dogged position is depicted in FIG. 11. When this feature is employed, actuator link basket 106 prevents actuator pin 32 from moving downward and thus retains the locking bolts in the retracted position. The dogging mechanism of the invention is designed to insure that arm 54 is securely held in the active position when dogging is employed.

Although inactive unit housing 56 has not been depicted in detail nor has its internal mechanisms been described, it is a feature of the present invention that inactive unit housing 56 and all of its internal mechanisms are an exact copy of active unit housing 52 and all its internal mechanisms except that actuator link 100 is not present. Since both housings may be dogged, additional stability is provided for panic bar 60 and arms 54 and 58 when the door is in the dogged configuration.

Figure 4:
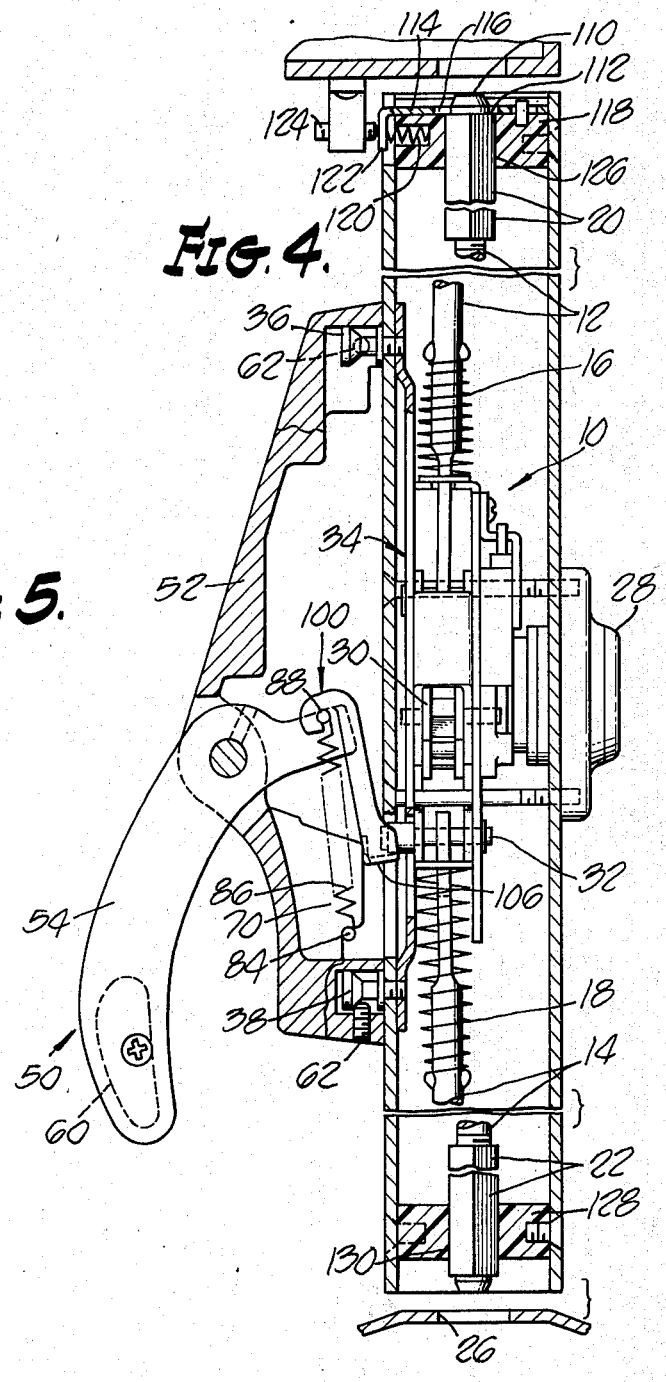
FIG. 4 is a sectional side elevation of an active door stile of the invention showing the locking mechanism therein and actuator device mounted on the active stile in the active position.
Figure 6:
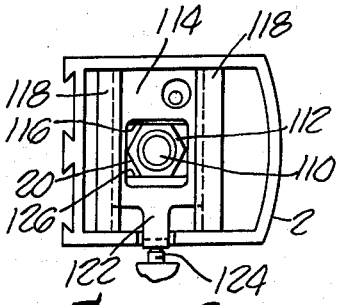
FIGS. 6 and 7 are plan views of the latching mechanism taken along the line 6—6 shown in FIG. 5 with FIG. 6 illustrating the tripped configuration of the mechanism, such as when the door is closed, and FIG. 7 illustrating the latching configuration for swinging of the door.
Figure 7:
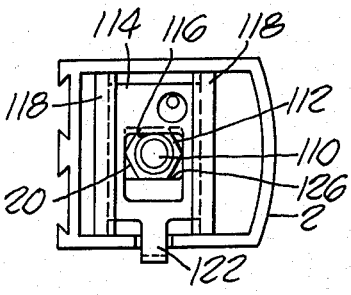

In one embodiment of the invention, the panic exit device is provided with latching means for restraining locking bolts 20 and 22 in the retracted position. The latching means is best depicted in FIGS. 4, 6, and 7. In this embodiment locking bolt 20 is hexagonal in cross section and is provided with head portion 110 smaller in diameter than the body of locking bolt 20 and thus creating ledge 112 around the head portion. The latching means comprising slidable member 114, provided with aperture 116, is slidably mounted in mounting member 118 and biased in the latching position depicted in FIG. 7 by spring 120. When the door is in the closed position, protrusion 122 on slidable member 114 engages protrusion 124 connected to the doorway to force member 114 to the position depicted in FIG. 6 thereby disengaging bolt 20 and allowing it to freely pass through aperture 116. It can be seen that when retraction mechanism 10 is actuated to retract bolts 20 and 22, and active stile 2 is swung away from protrusion 124, slidable member 114 will assume the position shown in FIG. 7, and will restrain bolts 20 and 22 from returning to the locking position even after the key has been withdrawn from locking mechanism 28 or the upward force is removed from actuator pin 32.

In this embodiment of the invention, locking bolts 20 and 22 have a hexagonal cross section, and support member 118 is provided with aperture 126 which has opposite sides spaced apart to slidably engage bolt 20, but to prevent it from rotating within support member 118. A similar apertured support member 128 is provided near the bottom of stile 2 having aperture 130 with opposite sides spaced apart to slidably engage bolt 22, but to prevent it from rotating therein. The configuration of support members 118 and 128 taken with the hexagonal cross section of bolts 20 and 22 and the fact that the bolts are threadably mounted on connector rods 12 and 14 allow fine adjustment of the distance bolts 20 and 22 protrude above the top and bottom of the door stile 2 respectively. This feature of the invention is important since it is desirable to have a high degree of flexability in adjusting the distance the bolts extend beyond the door stile. This distance is most often not known when the door is ordered and the adjustments must be made on the job. In installing a panic exit device of the invention, it is most usual to install the device on the door and then adjust the distance bolts 20 and 22 extend beyond the door in the locking position by rotating them on threaded shafts 12 and 14. Support members 118 and 128 are then installed to retain the bolts in the desired position. Should any changes in conditions occur, it is a simple matter to remove the support members and finely adjust the position of bolts 20 and 22. The hexagonal cross section of the bolt allows adjustments to be made in 1/6 increments of the thread flight length. Of course, other cross sectional shapes such as a square or octagon could be employed to allow different degrees of adjustment.

Having fully described my invention, it is to be understood that I do not wish to be limited to the details of the embodiments herein set forth or to the details illustrated in the drawings, but my invention is of the full scope of the appended claims.

I claim:

1. In a panic exit device, suitable for mounting on a door having an active stile containing a vertically operating locking bolt; a locking bolt retraction mechanism for causing reciprocating movement of the bolt, the retraction mechanism being activated by the vertical upward movement of an actuating pin operably connected to said retraction mechanism; and an actuator device mounted on the stile for urging the actuating pin vertically upward; the improvement wherein the actuator device comprises:

an active unit housing mounted on the active stile;

an arm pivotally mounted in the active unit housing having a first end thereof extending from said housing and a second end thereof contained within said housing; and an actuator link in said housing removably mounted on said second end of the arm by one end thereof and engaging the actuating pin at the other end thereof so that pivotal movement of the arm toward an active position causes a vertical upward movement of the actuator link which in turn causes a like vertical upward movement of the actuating pin wherein the actuator device is rendered inactive by removal of the actuator link therefrom.

2. The panic exit device of claim 1 wherein the actuator device further comprises means for biasing the arm to an inactive position.

3. The panic exit device of claim 1 wherein the actuator device includes dogging means mounted in the active unit housing for dogging the actuator device in the active position whereby the actuating pin in restrained in the upward position and the locking bolt is thus restrained in the retracted position.

4. The panic exit device of claim 3 wherein the dogging means includes pin means mounted in said dogging means and axially rotatable and movable to an active dogging position and an inactive position and means for biasing the pin means to the inactive position.

5. The panic exit device of claim 1 wherein the locking bolt retraction mechanism is mounted in the active stile by shoulder screws, the shoulders of which protrude from the interior of the stile, and the actuator device further comprises means for mounting the active unit housing on the shoulder screws.

6. In a panic exit device, suitable for mounting on a door having an active stile, containing a vertically operating locking bolt; a locking bolt retraction mechanism for causing reciprocating movement of the bolt between an extended locking position and a retracted position, the retraction mechanism being activated by the vertical upward movement of an actuating pin operably connected to said retraction mechanism; means for biasing the locking bolt in an extended locking position; an actuator device mounted on the stile for urging the actuating pin vertically upward; and latching means operably connected to the locking bolt for engaging and releasably retraining the locking bolt in the retracted position, the latching means comprising an apertured slidable member for engaging the locking bolt when restraining it in the retracted position and for allowing the locking bolt to pass therethrough when the locking bolt is released, means for biasing the slidable member to a position for retaining the bolt retracted unless the door is closed, and an apertured mounting member for positioning the slidable member in engaging relationship to the locking bolt and for allowing the locking bolt to pass through said mounting member wherein the improvement comprises:

a locking bolt of hexagonal cross section threadably mounted on the locking bolt retraction mechanism at one end thereof and having a ledge for engaging the latching means at the other end thereof, and an aperture in the support member having opposite sides spaced apart so as to allow the locking bolt to slidably pass therethrough but to prevent it from rotating therein.

7. In a panic exit device suitable for mounting on a door having an active stile containing a vertically operating locking bolt; a locking bolt retraction mechanism for causing reciprocating movement of the bolt from an extended locking position to a retracted position, the retraction mechanism being activated by the vertical upward movement of an actuating pin operably connected to said retraction mechanism; means for biasing the locking bolt to the locking position; latching means operably connected to the locking bolt for engaging and releaseably restraining the locking bolt in the retracted position when the door is open; and an actuator device mounted on the stile for urging the actuating pin vertically upward, the improvement wherein the actuator device comprises:

an active unit housing mounted on the active stile;

an arm pivotally mounted on the active unit housing having a first end thereof extending from said housing and a second end thereof contained within said housing;

means mounted in said housing for biasing the arm to a first inactive position; and an actuator link in said housing removably mounted on said second end of the arm by one end thereof and engaging the underside of the actuating pin at the other end thereof so that pivotal movement of the arm to a second active position causes a vertical upward movement of the actuating pin thereby retracting the locking bolt which, upon opening of the door will be held in the retracted position by the latching means whether or not the arm and thereby the actuator link is maintained in the active position or returned to the inactive position by the biasing means.

8. In a panic exit device, suitable for mounting on a door having an inactive stile and an active stile containing vertically operating locking bolts; a locking bolts retraction mechanism for causing opposite reciprocating movement of the bolts, the retraction mechanism being activated by the vertical upward movement of an actuating pin operably connected to said retraction mechanism; and an actuator device mounted on the stile for urging the actuator pin vertically upward; the improvement wherein the actuator device comprises:

an active unit housing mounted on the active stile;

an inactive unit housing mounted on the inactive stile;

a first arm pivotally mounted on the active unit housing, a second arm pivotally mounted on the inactive unit housing and a panic bar mounted at one end thereof on a first end of the first arm and at the other end thereof on a first end of the second arm; and, in the active unit housing, an actuator link removably mounted by one end thereof on the second end of the first arm and engaging the actuating pin at the other end thereof so that the pivotal movement of the arm toward an active position causes a vertical upward movement of the actuator link which in turn causes a like vertical upward movement of the actuating pin wherein the inactive unit housing is identical to the active unit housing and the active unit housing is rendered inactive by removal of the actuator link therefrom.

9. The panic exit device of claim 8 wherein the actuator device further comprises, in both the active and inactive unit housing, means for biasing the first and second arms to an inactive position.

10. The panic exit device of claim 8 wherein the actuator device further comprises, in both the active and inactive unit housings, dogging means mounted therein for dogging the actuator device in the active position whereby the actuating pin is restrained in the upward position and the locking bolts are thus restrained in the retracted position.

11. In a panic exit device, suitable for mounting on a door having an inactive stile and an active stile containing vertically operating locking bolts; a locking bolts retraction mechanism for causing opposite reciprocating movement of the bolts, the retraction mechanism being activated by the vertical upward movement of an actuating pin operably connected to said retraction mechanism; and an actuator device mounted on the active stile for urging the actuating pin vertically upward; the improvement wherein the actuator device comprises:

an active unit housing mounted on the active stile;

an inactive unit housing mounted on the inactive stile;

a first arm pivotally mounted in the active unit housing, a second arm pivotally mounted in the inactive unit housing and a panic bar mounted at one end thereof on a first end of the first arm and on the other end thereof on a first end of the second arm;

means, in both the active and the inactive unit housing, for biasing the first arm and the second arm respectively to inactive positions;

dogging means mounted in both the active unit housing and the inactive unit housing for dogging the actuator device in an active position whereby the actuating pin is restrained in the upward position and the locking bolts are thus restrained in the retracted position; and, in the active unit housing, an actuator link removably mounted by one end thereof on the second end of the first arm and engaging the actuating pin at the other end thereof so that pivotal movement of the first arm toward an active position causes a vertical upward movement of the actuating pin wherein the active unit housing and the inactive unit housing are identical and wherein the active unit housing is rendered inactive by removal of the actuator link therefrom.

12. In a panic exit device, suitable for mounting on a door having an active stile containing a vertically operating locking bolt; a locking bolt retraction mechanism for causing reciprocating movement of the bolt, the retraction mechanism being activated by the vertical upward movement of an actuating pin operably connected to said retraction mechanism; and an actuator device mounted on the stile for urging the actuating pin vertically upward; the improvement wherein the actuator device comprises:

an active unit housing mounted on the active stile;

an arm pivotally mounted in the active unit housing;

means for biasing the arm to an inactive position, said biasing means comprising a first spring pin; a second spring pin; and a pair of restraining springs wherein the first spring pin is mounted on an end of the arm, the pair of restraining springs are mounted at the first end thereof on the first spring pin and at the second end thereof on the second spring pin, the second spring pin being restrained against the retractive force of the springs by a boss provided in the active unit housing at the lower end thereof so that the retractive force of the spring urges the end of the arm downward; and an actuator link removably mounted on the arm by one end thereof and engaging the actuating pin at the other end thereof so that pivotal movement of the arm toward an active position causes a vertical upward movement of the actuator link which in turn causes a like vertical upward movement of the actuating pin wherein the actuator device is rendered inactive by removal of the actuator link therefrom.

13. In a panic exit device, suitable for mounting on a door having an active stile containing a vertically operating locking bolt; a locking bolt retraction mechanism for causing reciprocating movement of the bolt, the retraction mechanism being activated by the vertical upward movement of an actuating pin operably connected to said retraction mechanism; and an actuator device comprises:

an active unit housing mounted on the active stile;

an arm pivotally mounted on the active unit housing;

dogging means mounted in the active unit housing for dogging the actuator device in the active position said dogging means comprising a dogging pin comprising a shaft with a bore therein and a screwhead at one end thereof axially rotatably and movably mounted in a boss provided in the active unit housing, a roll pin mounted in said bore, and a dogging pin spring mounted on the dogging pin so as to urge the dogging pin in a direction outwardly of the active unit housing wherein in a first inactive position the roll pin is positioned to retain the dogging pin within the housing in a retracted position and wherein, the second active position, the dogging pin has been forced into the active unit housing and rotated to bring the roll pin to a position to retain the dogging pin in the active position thereby dogging the actuator device in the active position whereby the actuating pin is restrained in the upward position and the locking bolt is thus restrained in the retracted position; and an actuator link removably mounted on the arm by one end thereof and engaging the actuating pin at the other end thereof so that pivotal movement of the arm toward an active position causes a vertical upward movement of the actuator link which in turn causes a like vertical upward movement of the actuating pin wherein the actuator device is rendered inactive by removal of the actuator link therefrom.

* * * * *